US009583243B2

(12) United States Patent
Horiuchi et al.

(10) Patent No.: US 9,583,243 B2
(45) **Date of Patent: *Feb. 28, 2017**

(54) PERMANENT MAGNET AND METHOD FOR MANUFACTURING THE SAME, AND MOTOR AND POWER GENERATOR USING THE SAME

(75) Inventors: Yosuke Horiuchi, Tokyo (JP); Shinya Sakurada, Shinagawa-ku (JP); Keiko Okamoto, Kawasaki (JP); Masaya Hagiwara, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 8 days.

This patent is subject to a terminal disclaimer.

(21) Appl. No.: 13/048,321

(22) Filed: Mar. 15, 2011

(65) Prior Publication Data

US 2012/0074804 A1 Mar. 29, 2012

(30) Foreign Application Priority Data

Sep. 24, 2010 (JP) ..... 2010-213423

(51) Int. Cl.
*B22F 3/12* (2006.01)
*H01F 7/02* (2006.01)
(Continued)

(52) U.S. Cl.
CPC ..... *H01F 1/0596* (2013.01); *C22C 1/02* (2013.01); *C22C 28/00* (2013.01); *C22C 33/04* (2013.01);
(Continued)

(58) Field of Classification Search
CPC ..... H01F 1/0596
(Continued)

(56) References Cited

U.S. PATENT DOCUMENTS 4,746,378 A * 5/1988 Wysiekierski et al. ..... 148/101
7,713,360 B2 5/2010 Ohashi
(Continued)

FOREIGN PATENT DOCUMENTS

CN 101490946 7/2009
EP 1 569 247 B1 8/2005
(Continued)

OTHER PUBLICATIONS

English Machine Translation of JP 4764526 (Equivalent to WO 2009/145229 with a publication date of Mar. 12, 2009).*
(Continued)

*Primary Examiner* — Jie Yang
*Assistant Examiner* — Xiaowei Su
(74) *Attorney, Agent, or Firm* — Oblon, McClelland, Maier & Neustadt, L.L.P.

(57) ABSTRACT

In an embodiment, a permanent magnet includes a composition of R $(Fe_pM_qCu_r(Co_{1-s}A_s)_{1-p-q-r})_z$ (R: rare earth element, M: Ti, Zr, Hf, A: Ni, V, Cr, Mn, Al, Si, Ga, Nb, Ta, W, $0.05 \leq p$ 0.6, $0.005 \leq q \leq 0.1$, $0.01 \leq r \leq 0.15$, $0 \leq s \leq 0.2$, $4 \leq z \leq 9$). The permanent magnet includes a two-phase structure of a $Th_2Zn_{17}$ crystal phase and a copper-rich phase. An average interval between the copper-rich phases in a cross section including a crystal c axis of the $Th_2Zn_{17}$ crystal phase is in a range of over 120 nm and less than 500 nm.

19 Claims, 6 Drawing Sheets

(51) Int. Cl.

| | |
|---|---|
| ***B22F 3/24*** | (2006.01) |
| ***H01F 1/059*** | (2006.01) |
| ***C22C 1/02*** | (2006.01) |
| ***C22C 28/00*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/10*** | (2006.01) |
| ***C22C 38/14*** | (2006.01) |
| ***C22C 38/16*** | (2006.01) |
| *C21D 8/12* | (2006.01) |

(52) U.S. Cl.
CPC ..... *C22C 38/005* (2013.01); *C22C 38/02* (2013.01); *C22C 38/04* (2013.01); *C22C 38/10* (2013.01); *C22C 38/14* (2013.01); *C22C 38/16* (2013.01); *C21D 8/1205* (2013.01); *C22C 2202/02* (2013.01)

(58) Field of Classification Search
USPC ..... 148/101, 303
See application file for complete search history.

(56) References Cited

U.S. PATENT DOCUMENTS

| | | | | |
|---|---|---|---|---|
| 8,179,068 | B2 | 5/2012 | Yuuki et al. | |
| 8,211,246 | B2 * | 7/2012 | Hagiwara et al. | 148/303 |
| 8,552,678 | B2 | 10/2013 | Yuuki et al. | |
| 8,884,576 | B2 | 11/2014 | Yuuki et al. | |
| 9,087,631 | B2 * | 7/2015 | Horiuchi | C22C 19/07 |
| 2002/0054825 | A1 * | 5/2002 | Sukaki et al. | 420/83 |
| 2007/0051431 | A1 * | 3/2007 | Sakaki et al. | 148/105 |
| 2009/0261774 | A1 | 10/2009 | Yuuki et al. | |
| 2013/0241333 | A1 * | 9/2013 | Horiuchi | C22C 19/07 310/152 |
| 2014/0184133 | A1 | 7/2014 | Yuuki et al. | |

FOREIGN PATENT DOCUMENTS

| | | | | |
|---|---|---|---|---|
| EP | 2 048 772 | A1 | 4/2009 | |
| GB | 2021147 | A * | 11/1979 | C22C 19/07 |
| JP | 9-111383 | | 4/1997 | |
| JP | 2002-83707 | A | 3/2002 | |
| JP | 2002-246215 | | 8/2002 | |
| JP | 2005-243884 | | 9/2005 | |
| JP | 2008-29148 | | 2/2008 | |
| JP | 2008-43172 | | 2/2008 | |
| JP | EP 2 048 772 | * | 4/2009 | |
| JP | 2010-121167 | | 6/2010 | |
| JP | 2010-121167 | A | 6/2010 | |
| JP | 2010123722 | A * | 6/2010 | |
| WO | WO 2009/145229 | A1 | 12/2009 | |
| WO | WO2010/058555 | | 5/2010 | |

OTHER PUBLICATIONS

Hadjipanayis et al. IEEE Transactions on Magnetics, 2000, vol. 36, p. 3382-3387.*
Huang et al. (J of Applied Physics, 1994, vol. 75, p. 6280-6282).*
Machine translation of JP2010-123722A, Jun. 2010.*
Japanese Office Action Issued Jul. 24, 2012 in Patent Application No. 2010-213423 (with English translation).
Office Action issued May 9, 2014, in Chinese patent application No. 201110291171 (w/ English translation).

* cited by examiner

PERMANENT MAGNET AND METHOD FOR MANUFACTURING THE SAME, AND MOTOR AND POWER GENERATOR USING THE SAME

CROSS-REFERENCE TO RELATED APPLICATIONS

This application is based upon and claims the benefit of priority from the prior Japanese Patent Application No. 2010-213423, filed on Sep. 24, 2010; the entire contents of which are incorporated herein by reference.

FIELD

Embodiments described herein relate generally to a permanent magnet and a method for manufacturing the same, and to a motor and a power generator using the same.

BACKGROUND

In a variable magnetic flux motor or a variable magnetic flux generator, two kinds of magnets, i.e. a variable magnet and a stationary magnet, are used. The variable magnet is demagnetized by an electric current magnetic field at a time of high-speed rotation of the variable magnetic flux motor or the variable magnetic flux generator, and is magnetized again by the electric current magnetic field in a driving state where a torque is necessary. In the variable magnet, a demagnetizing operation and a magnetizing operation are performed. The magnetizing operation returning from a demagnetized state to a magnetized state again is a problem.

Since an iron core is magnetically saturated and a magnetomotive force is consumed in the magnetizing operation, a magnetizing current required is increased. Therefore, the magnetization current in the magnetizing operation is larger than in the demagnetizing operation. If the variable magnet can be magnetized by a small magnetization current, further low power consumption of the variable magnetic flux motor or the variable magnetic flux generator can be realized. Conventionally, as the variable magnet, an Al—Ni—Co magnet (alnico magnet) or a Fe—Cr—Co magnet is used. Improvement of a magnetic coercive force and a magnetic flux density of the variable magnet is required in order for a high performance or a high efficiency of the variable magnetic flux motor or the variable magnetic flux generator.

DETAILED DESCRIPTION

Figure 1:
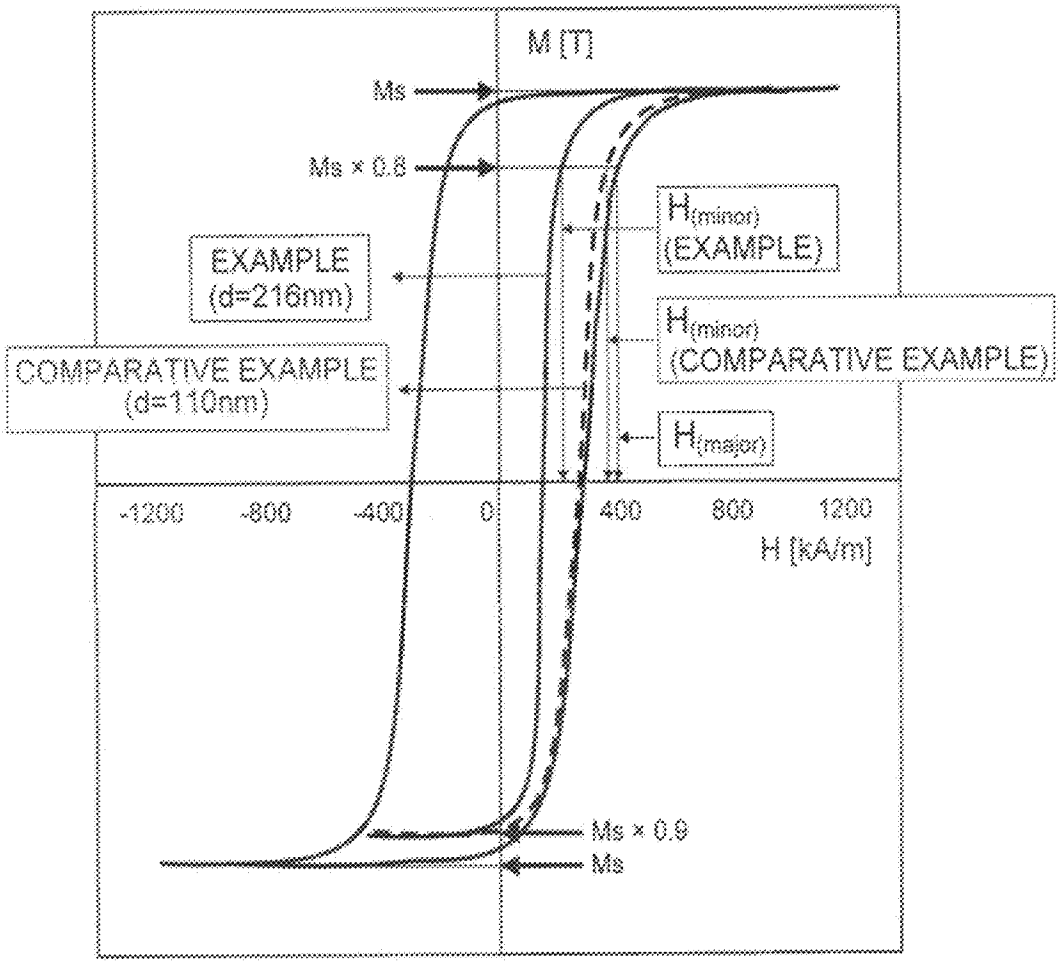
FIG. 1 is a graph illustrating an example of a magnetization curve of a permanent magnet of an embodiment.

According to an embodiment, there is provided a permanent magnet having a composition represented by a composition formula:

$$R(Fe_pM_qCu_r(Co_{1-s}A_s)_{1-p-q-r})_z \quad (1)$$

where, R is at least one element selected from rare earth elements, M is at least one element selected from Ti, Zr and Hf, A is at least one element selected from Ni, V, Cr, Mn, Al, Si, Ga, Nb, Ta and W, p is a number (atomic ratio) satisfying $0.05 \le p \le 0.6$, q is a number (atomic ratio) satisfying $0.005 \le q \le 0.1$, r is a number (atomic ratio) satisfying $0.01 \le r \le 0.15$, s is a number (atomic ratio) satisfying $0 \le s \le 0.2$, and z is a number (atomic ratio) satisfying $4 \le z \le 9$. The permanent magnet includes a structure which includes a $Th_2Zn_{17}$ crystal phase (2-17 phase) and a copper-rich phase ($CaCu_5$ crystal phase (1-5 phase) or the like) having a copper concentration in a range from 1.2 to 5 times a copper concentration in the $Th_2Zn_{17}$ crystal phase, and an average interval d between the copper-rich phases in a cross section including a crystal c axis of the $Th_2Zn_{17}$ crystal phase is in a range of over 120 nm and less than 500 nm.

As a high-performance permanent magnet, an Sm—Co based magnet is known. An $Sm_2Co_{17}$ type magnet among the Sm—Co based magnets has a two-phase separation structure of a 2-17 phase and a 1-5 phase, and has a magnet property by a magnetic coercive force exhibiting mechanism of a magnetic domain wall pinning type. The $Sm_2Co_{17}$ type magnet is a magnet suitable for the variable magnet. However, due to a fact that a conventional $Sm_2Co_{17}$ type magnet has an excessive pinning effect, an external magnetic field, in other words, a magnetizing current necessary for a magnetizing cannot be reduced.

The permanent magnet of the embodiment will be explained. The permanent magnet of the embodiment has the composition represented by the formula (1). In the formula (1), at least one element selected from the rare earth elements including yttrium (Y) is used as the element R. The element R introduces a large magnetic anisotropy into a magnet material, giving a high magnetic coercive force. It is preferable to use at least one selected from samarium (Sm), cerium (Ce), neodymium (Nd) and praseodymium (Pr) as the element R, and it is more preferable to use Sm. Containing Sm as 50 atomic % or more of the element R can heighten a performance of the permanent magnet, especially the magnetic coercive force, with good repeatability. Further, it is desirable that 70 atomic % or more of the element R is Sm.

The element R is compounded so that an atomic ratio of the element R and other elements (Fe, M, Cu, Co, A) is in a range of 1:4 to 1:9 (range of 4 to 9 as the value z/10 to 20 atomic % as the content of the element R). If the content of the element R is less than 10 atomic %, a large amount of α-Fe phase precipitates and a sufficient magnetic coercive force cannot be obtained. On the other hand, the content of the element R over 20 atomic % brings about a notable reduction of a saturation magnetization. It is more preferable that the content of the element R is in a range of 10 to 15 atomic %, and it is further preferable that the content of the element R is in a range of 10.5 to 12.5 atomic %.

As the element M, at least one element selected from titanium (Ti), zirconium (Zr) and hafnium (Hf) is used. By compounding the element M, a large magnetic coercive force can be exhibited by a high iron density composition. A content of the element M is in a range of 0.5 to 10 atomic % (0.005 q 0.1) of a total amount of the elements (Fe, Co, Cu, M) except the element R. If the value q exceeds 0.1, a notable reduction of a magnetization is brought about. If the value q is less than 0.005, an effect of heightening the iron density is small. It is more preferable that the content of the element M is $0.01 \leq q \leq 0.06$, and it is further preferable that the content of the element M is $0.015 \leq q \leq 0.04$.

The element M may be any one of Ti, Zr, Hf, but it is preferable that at least Zr is included. Containing Zr as 50 atomic % or more of the element M can further improve an effect of heightening the magnetic coercive force of the permanent magnet. Since Hf is particularly expensive among the elements M, even if Hf is used, it is preferable an amount of Hf to be used is small. It is preferable that a content of Hf is less than 20 atomic % of the element M.

Copper (Cu) is an element for making the permanent magnet exhibit a high magnetic coercive force. A compound amount of Cu is in a range of 1 to 15 atomic % ($0.01 \leq r \leq 0.15$) of the total amount of the elements (Fe, Co, Cu, M) except the element R. If the value r exceeds 0.15, a notable reduction of the magnetization is brought about. If the value r is less than 0.01, it becomes difficult to obtain the high magnetic coercive force. It is more preferable that the compound amount of Cu is $0.02 \leq r \leq 0.1$, and it is further preferable the compound amount of Cu is $0.03 \leq r \leq 0.08$.

Iron (Fe) is mainly responsible for a magnetization of a permanent magnet. Compounding a large amount of Fe leads to heightening the saturation magnetization of the permanent magnet. However, an excessive content of Fe leads to precipitation of an α-Fe phase or difficulty in obtaining a two-phase structure of the 2-17 phase and the copper-rich phase (1-5 phase or the like). By the above, the magnetic coercive force of the permanent magnet is reduced. A compound amount of Fe is in a range of 5 to 60 atomic % ($0.05 \leq p \leq 0.6$) of the total amount of elements (Fe, Co, Cu, M) except the element R. It is more preferable that the compound amount of Fe is $0.26 \leq p \leq 0.5$, and it is further preferable that the compound amount of Fe is $0.28 \leq p \leq 0.48$.

Cobalt (Co) is an element responsible for a magnetization of a permanent magnet and necessary for exhibition of a high magnetic coercive force. Further, when a large amount of Co is contained, a Curie temperature becomes high, and a thermal stability of the permanent magnet also being improved. If a compound amount of Co is small, such effects are small. However, if Co is excessively contained in the permanent magnet, the content of Fe being relatively decrease, a reduction of the magnetization might be brought about. A content of Co is in a range (1-p-q-r) defined by p, q, r.

Part of Co can be replaced by at least one element A selected from nickel (Ni), vanadium (V), chromium (Cr), manganese (Mn), aluminum (Al), silicon (Si), gallium (Ga), niobium (Nb), tantalum (Ta), and tungsten (W). Those substitution elements contribute to improvement of the magnet property, the magnetic coercive force, for example. Since excessive substitution of the element A for Co might cause a reduction of the magnetization, an amount of substitution by the element A is in a range of equal to or less than 20 atomic % ($0 \leq s \leq 0.2$) of Co.

The permanent magnet of the embodiment includes the two-phase structure which includes the 2-17 phase and the copper-rich phase (1-5 phase or the like) having the copper concentration in a range from 1.2 to 5 times the copper concentration of the 2-17 phase. Further, in the cross section including the crystal c axis of the 2-17 phase, the average interval d between the copper-rich phases is in a range of over 120 nm and less than 500 nm.

An $Sm_2Co_{17}$ type magnet, whose precursor is a $TbCu_7$ crystal phase (1-7 phase) being a high-temperature phase, obtains a magnet property as a result that an aging processing is performed to the precursor thereby to phase-separate into a $Th_2Zn_{17}$ crystal phase (2-17 phase) and a $CaCu_5$ crystal phase (1-5 phase), based on a magnetic coercive force exhibiting mechanism of a magnetic domain wall pinning type. The 2-17 phase becomes a main phase (grain interior phase), into whose grain boundary the 1-5 phase (grain boundary phase) precipitates thereby dividing the 2-17 phases, and a secondary structure called a cell structure is made. By spinodal decomposition, the 1-5 phase becomes Cu-rich and Fe-poor, and the 2-17 phase becomes Cu-poor and Fe-rich.

It should be noted that the permanent magnet of the embodiment may include a crystal phase other than the 2-17 phase and the Cu-rich phase, or an amorphous phase. As another phase, there can be thought of an M-rich phase in which a density of the element M is more than that of the inner grain phase, a compound phase whose main constituent is the element R and Fe, or the like. It is preferable that an amount of such a phase, excluding the M-rich phase, is almost an amount of an impurity phase. It is preferable that the permanent magnet is constituted by the 2-17 phase and the Cu-rich phase, in practice.

An origin of the magnetic coercive force in the $Sm_2Co_{17}$ type magnet is in a microstructure generated by phase decomposition. A magnetic domain wall energy of the 1-5 phase precipitated into the grain boundary is large compared with a magnetic domain wall energy of the 2-17 phase being the main phase, a difference between the magnetic domain wall energies becoming a barrier against magnetic domain wall displacement. In other words, the 1-5 phase, whose magnetic domain wall energy is larger, works as a pinning site. It is considered that the difference between the magnetic domain wall energies is generated mainly by a density difference of copper (Cu). When a Cu concentration of the phase precipitating into the grain boundary is sufficiently higher than a Cu concentration inside the grain, a magnetic coercive force is exhibited. Thus, a Cu-rich phase is applied as the pinning site.

As a representative example of the Cu-rich phase, the above-described $CaCu_5$ crystal phase (1-5 phase) can be cited, but the Cu-rich phase is not necessarily limited thereto. It suffices when the Cu-rich phase has a Cu concentration in a range from 1.2 to 5 times a Cu concentration of the 2-17 phase being the main phase. When the Cu concentration of the Cu-rich phase is equal to or more than 1.2 times the Cu concentration of the 2-17 phase, it is possible to make the Cu-rich phase function as the pinning site. However, if the Cu concentration of the Cu-rich phase exceeds 5 times the Cu concentration of the 2-17 phase, a magnetic coercive force becomes too large and becomes improper for a variable magnet. As a Cu-rich phase other than the 1-5 phase, there can be cited a 1-7 phase being a high-temperature phase, a precursor of the 1-5 phase generated in an initial stage of two-phase separation of the 1-7 phase.

As described above, a magnetic property of the $Sm_2Co_{17}$ type magnet is affected by the Cu-rich phase. For example, if a thickness of the Cu-rich phase is thick, the pinning effect of the magnetic domain wall becomes too high, which might cause exhibition of a gigantic magnetic coercive force. When the permanent magnet is used as a variable magnet, it is preferable that the permanent magnet has a proper magnetic coercive force. More specifically, it is preferable that the magnetic coercive force of the permanent magnet used as the variable magnet is in a range from 100 to 500 kA/m. If the magnetic coercive force of the permanent magnet exceeds 500 kA/m, use as the variable magnet becomes difficult. If the magnetic coercive force of the permanent magnet is less than 100 kA/m, a high performance of the variable magnet cannot be sufficiently sought.

In view of the above, it is preferable that an average thickness of the Cu-rich phase is 20 nm or less. By making the average thickness t of the Cu-rich phase be 20 nm or less, a proper pinning effect of the magnetic domain wall can be obtained. Therefore, it is possible to stably provide a permanent magnet having a magnetic coercive force in a range from 100 to 500 kA/m which is suitable for a variable magnet. It is more preferable that the magnetic coercive force of the permanent magnet is in a range from 200 to 400 kA/m. It is more preferable that the average thickness t of the Cu-rich phase is 15 nm or less, and it is further preferable that the average thickness t of the Cu-rich phase is 10 nm or less. However, if the average thickness t of the Cu-rich phase is too small, the pinning effect of the magnetic domain wall becomes too weak, which might reduce the magnetic coercive force excessively. It is preferable that the average thickness t of the Cu-rich phase is 1 nm or more.

Further, a precipitation interval of the Cu-rich phase affects a magnetic domain wall pinning behavior significantly. If the Cu-rich phase precipitates densely and the interval between the Cu-rich phases is small, the magnetic domain wall is firmly pinned. Therefore, an external magnetic field necessary for the magnetizing is almost equal to the magnetic coercive force and a reduction of a magnetization current cannot be expected. If the metallic structure can be controlled so that the precipitation interval of the Cu-rich phase becomes large, it becomes possible to magnetize the $Sm_2Co_{17}$ type magnet by a small external magnetic field, that is, a small magnetizing current. Thereby, a magnet enabling a low power consumption of a variable magnetic flux motor or a variable magnetic flux generator can be realized.

The metallic structure of the $Sm_2Co_{17}$ type magnet largely depends on a manufacturing process. In the aging treatment, after a heat processing is performed at a temperature of about 750 to 950° C., control cooling is performed, and at a time when cooling to a certain temperature is done, quenching is performed. If an aging treatment temperature is too low, precipitation of the Cu-rich phase becomes insufficient and an energy difference enough to hamper movement of the magnetic domain wall does not occur between the grain interior phase and the Cu-rich phase. As a result, the magnetic coercive force exhibition mechanism by the difference between the magnetic domain wall energies does not function. If the aging treatment temperature is too high, the Cu-rich phase becomes coarse and a property suitable for a variable magnet cannot be obtained. If such a manufacturing process of the permanent magnet is controlled and the precipitation interval of the Cu-rich phase can be controlled to be in a proper range while the thickness t of the Cu-rich phase is kept, the magnetic field necessary for the magnetization in the magnetic force increase can be reduced without making the magnetic coercive force gigantic.

Whether a magnetization property of the permanent magnet is good or bad is evaluated based on a ratio of H(minor) and H(major) obtained from a magnetization curve. H(major) is defined by using a sintered body magnet with a rectangular parallelepiped shape in a demagnetized state. H(major) is obtained as described below. First, an external magnetic field of 1200 kA/m is applied (magnetizing) in a positive direction in relation to an easy magnetization axis of the sintered body magnet with the rectangular parallelepiped shape in the demagnetized state. A maximum magnetization obtained on that occasion is a saturation magnetization Ms. After a magnetic field of 1200 kA/m is applied, an external magnetic field is applied (demagnetizing) as far as −1200 kA/m in a negative direction. A magnetization with a maximum absolute value obtained on this occasion is defined as −Ms. Thereafter, the external magnetic field of 1200 kA/m is applied (magnetizing) again in the positive direction. In the magnetizing, a magnetic field at a time when the magnetization reaches 80% of Ms is defined as H(major). A magnetization curve obtained as above is called a major loop.

H(minor) is obtained as described below. First, there is performed magnetizing-demagnetizing-magnetizing by application of the external magnetic fields in the respective positive and negative directions based on the above-described procedure, thereby drawing the major loop, and subsequently a magnetic field is applied (demagnetizing) in the negative direction. On this occasion, the magnetic filed to be applied is set to make a magnitude of a magnetization be 90% in relation to −Ms. After the magnetization magnitude becomes 90% in relation to −Ms, an external magnetic field is applied again in the positive direction, the external magnetic field of 1200 kA/m being applied (magnetizing). In the magnetizing, a magnetic field at a time when a magnetization reaches 80% of Ms is defined as H(minor). A magnetization curve obtained as above is called a minor loop.

The fact that the ratio of H(minor) to H(major) (H(minor)/H(major)) is small means that the magnetizing by a small magnetic field is possible. In the conventional $Sm_2Co_{17}$ type magnet, H(minor) is about 95% to H(major). Therefore, for an $Sm_2Co_{17}$ type magnet satisfying a condition represented by a formula:

$$H(\text{minor})/H(\text{major})<0.95 \quad (2)$$

a magnetic field necessary for remagnetizing can be made smaller compared with the conventional $Sm_2Co_{17}$ type magnet. According to such an $Sm_2Co_{17}$ type magnet, it becomes possible to provide a variable magnet enabling power saving in a variable magnetic flux motor or generator. It is more preferable that the H(minor)/H(major) ratio is 0.9 or less, and there by remarkable power saving is excepted. It is desirable that the H(minor)/H(major) ratio is 0.85 or less.

The permanent magnet of the embodiment is one in which the average interval d between the Cu-rich phases (grain boundary phases) in the cross section including the crystal c axis of the 2-17 phase is made in the range of over 120 nm and less than 500 nm (120 nm<d<500 nm), by applying the aging treatment condition or the like corresponding to the alloy composition thereby to control the metallic structure, in the permanent magnet which includes the two-phase separation structure of the grain interior phase (main phase) made of the 2-17 phase and the Cu-rich phase (1-5 phase or the like) precipitating into the grain boundary thereof. Thereby, a shape of the minor loop in the magnetization curve of the $Sm_2Co_{17}$ type magnet becomes asymmetric, and the magnetic field necessary for magnetizing can be reduced.

FIG. 1 is a graph illustrating an example of a magnetization curve of the magnet (example) whose Cu-rich phase average interval d is in a range of 120 nm<d<500 nm, in comparison with a magnetization curve of a magnet (comparative example) whose Cu-rich phase average interval d is equal to or less than 120 nm. As illustrated in FIG. 1, in the magnet (comparative example) whose Cu-rich phase average distance d is equal to or less than 120 nm, a shape of a minor loop in the magnetization curve is almost the same as a shape of a major loop, while in the magnet (example) whose Cu-rich phase average interval d is in the range of 120 nm<d<500 nm, a shape of a minor loop in the magnetization curve is asymmetric, and it is possible to reduce a magnetic field necessary for magnetizing.

Figure 2:
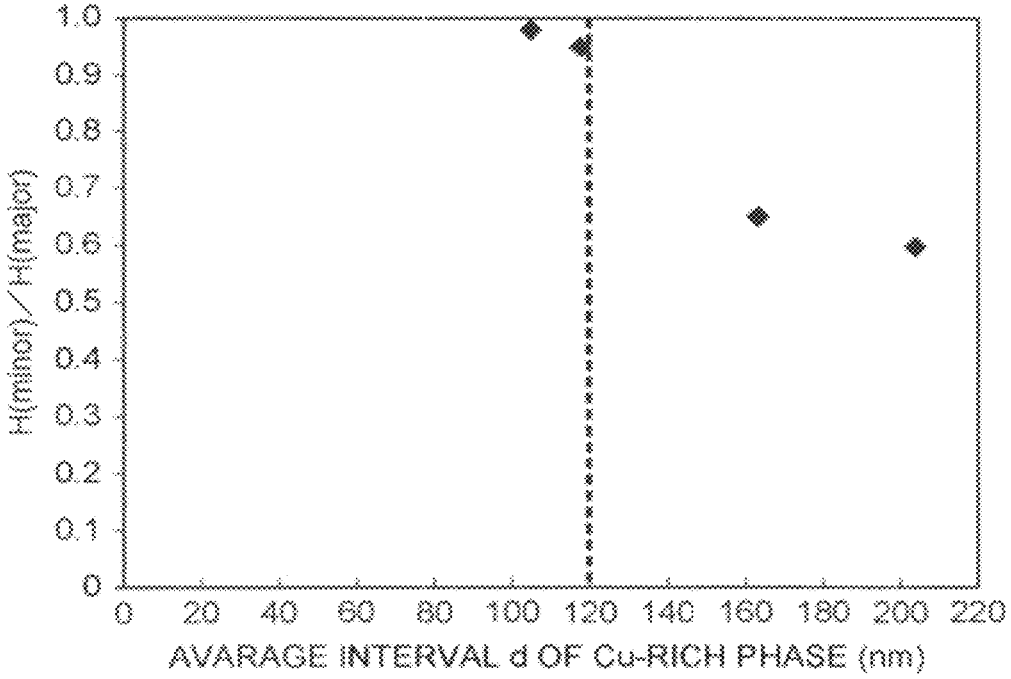
FIG. 2 is a graph illustrating a relationship between an average interval d of a copper-rich phase of an $Sm_2Co_{17}$ type magnet and an H(minor)/H(major) ratio.

According to the $Sm_2Co_{17}$ type magnet whose Cu-rich phase average thickness t is 20 nm or less and whose Cu-rich phase average interval d is in the range of 120 nm<d<500 nm, it is possible to reduce the external magnetic field, that is, the magnetization current necessary for magnetizing, based on the suitable magnetic domain wall pinning effect, while the magnetic coercive force and the variable width suitable for the variable magnet are kept. More specifically, the H(minor)/H(major) ratio can be made to be less than 0.95. FIG. 2 illustrates a relationship between the Cu-rich phase average interval d and the H(minor)/H(major) ratio. As illustrated in FIG. 2, by precipitating in a dispersed manner so that the Cu-rich phase average interval d exceeds 120 nm, the H(minor)/H(major) ratio can be made to be less than 0.95, further, to be 0.9 or less.

Figure 3:
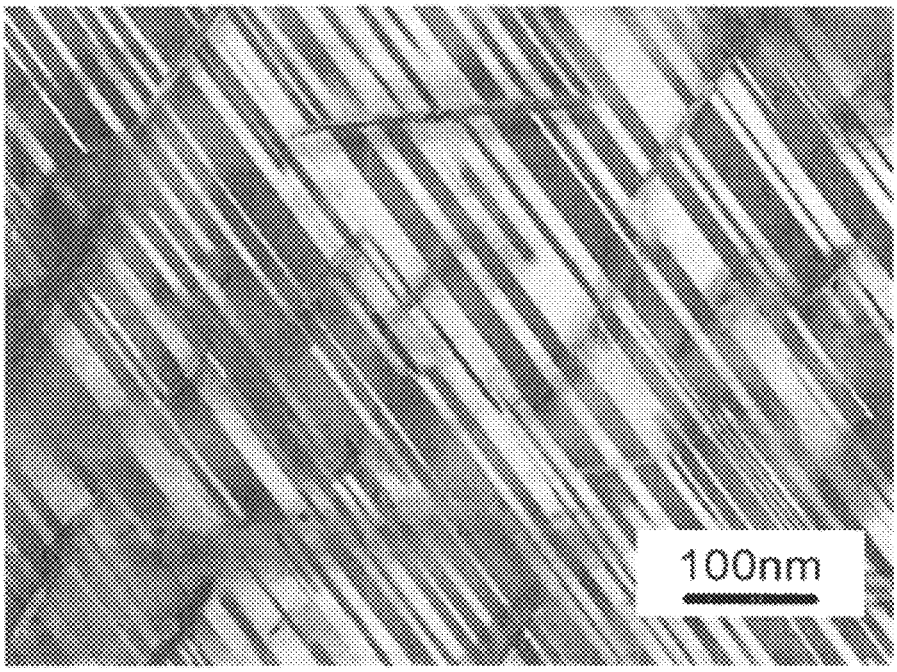
FIG. 3 is a TEM image illustrating a metallic structure of the permanent magnet of the embodiment in an enlarged manner.

If the average interval d of the Cu-rich phase is equal to or less than 120 nm, the pinning effect of the magnetic domain wall becomes notable, deteriorating the magnetization property. It is more preferable that the average interval d of the Cu-rich phase is 130 nm or more, and it is desirable that the average interval d of the Cu-rich phase is 150 nm or more. However, if the average interval d of the Cu-rich phase is equal to or more than 500 nm, due to a reason that the magnetic domain wall pinning effect does not work and the magnetic coercive force mechanism changes and so on, a phenomenon occurs in which a magnetization curve rapidly rises at a magnetic force increase after a magnetic force decrease, making it impossible to secure the variable width required of the variable magnet. It is more preferable that the average interval d of the Cu-rich phase is 450 nm or less. FIG. 3 illustrates an example of a cross section of the permanent magnet of the embodiment.

As described above, the Cu-rich phase is a region having the Cu concentration in the range from 1.2 to 5 times the Cu concentration of the 2-17 phase (grain interior phase). Therefore, by composition-analyzing the cross section including the crystal c axis of the 2-17 phase by an energy dispersive x-ray fluorescence spectrometer (EDX) or the like, the average interval d of the Cu-rich phase can be obtained. The cross section including the crystal c axis of the 2-17 phase is observed at a magnification of 100 k by a transmission electron microscope (TEM), a position of the Cu-rich phase is specified by performing composition line analysis of an obtained image, and the average interval d of the Cu-rich phase is defined as an average value of distances from a certain Cu-rich phase to a next Cu-rich phase.

The composition line analysis of the cross section image including the crystal c axis of the 2-17 phase is performed first at an interval of 30 to 50 nm in a certain direction (first direction), and is also performed next at a similar interval in a direction (second direction) orthogonal to the first direction in the same surface. The average interval d is a value obtained by averaging distances between the Cu-rich phases obtained in all the composition line analyses. A concrete example of how to obtain the average interval d of the Cu-rich phase is described below.

(1) Cross Section Observation Step

First, a cross section including a c axis of a 2-17 phase of a permanent magnet (sintered body magnetically oriented after an aging treatment) is observed by a TEM. An example of a TEM image (100 k times) being a cross section observation result of an $Sm_2Co_{17}$ type magnet according to the embodiment is illustrated in FIG. 3. In FIG. 3, a portion with uniform contrast is the 2-17 phase (grain interior phase), and a plate-shaped portion (dark colored region) existing thereamong is a Cu-rich phase.

(2) Composition Line Analysis Step

Figure 4:
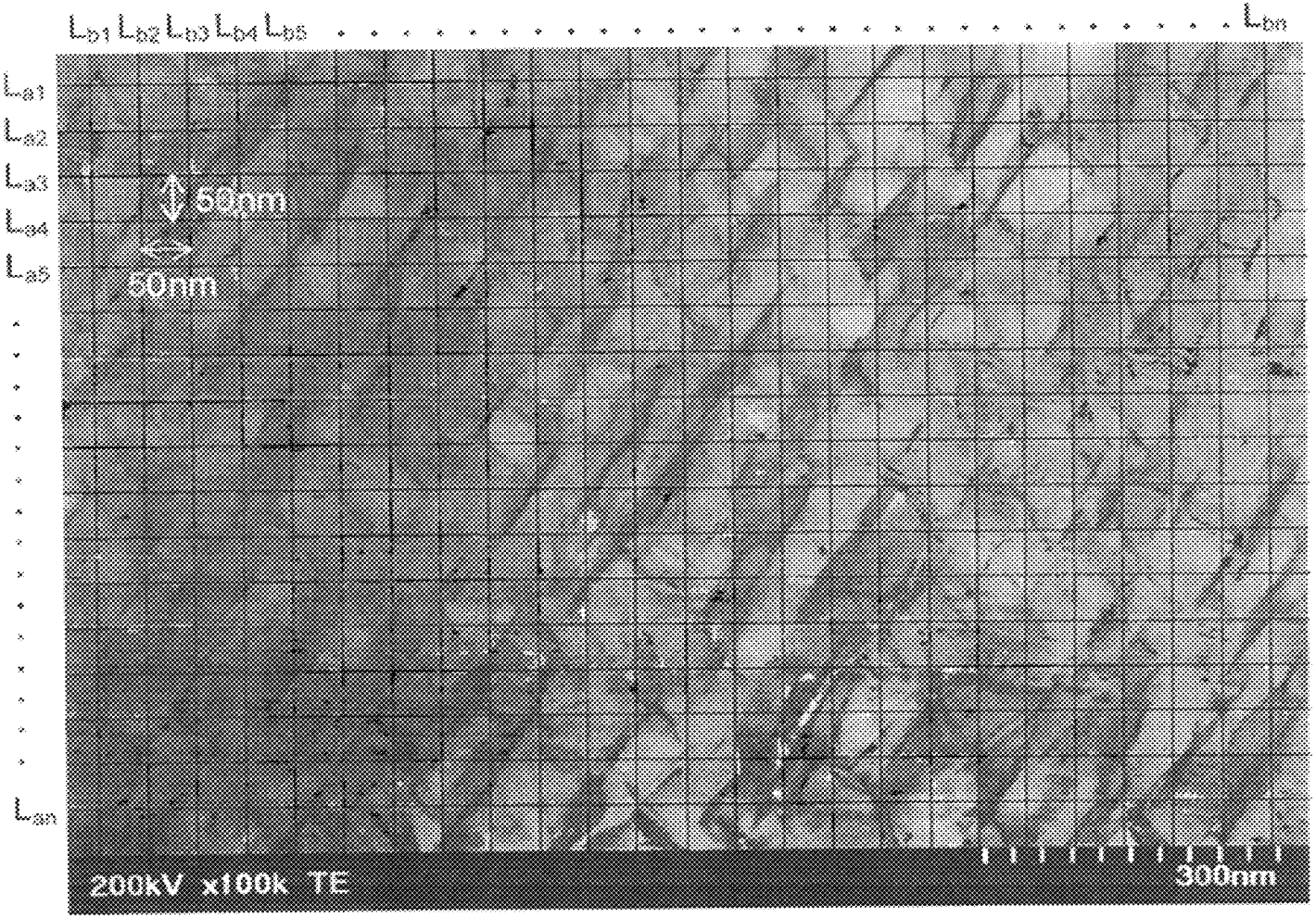
FIG. 4 is an image illustrating a state of a line analysis of a copper concentration for measuring an average interval of the copper-rich phase from the TEM image illustrated in FIG. 3.

Next, a composition line analysis of the TEM image being the cross section observation result of the permanent magnet is performed. FIG. 4 illustrates a state of the composition line analysis of the TEM image. Though FIG. 4 illustrates a TEM image different from that of FIG. 3, illustration is for the sake of convenience in explaining the following composition line analysis step and does not limit the present invention to any extent. First, a line analysis (La1 to Lan) is performed at even intervals in a first direction of the TEM image. The line analysis is performed at even intervals in parallel. The interval of the line analysis is 30 to 50 nm. Next, in the same TEM image, a line analysis (Lb1 to Lbn) is performed at even intervals in a second direction orthogonal to the first direction. The line analysis is also performed at even intervals of 30 to 50 nm in parallel. In FIG. 4, the interval of the line analysis (parallel lines) is 50 nm.

(3) Cu-Rich Phase Position Specifying Step

Figure 5:
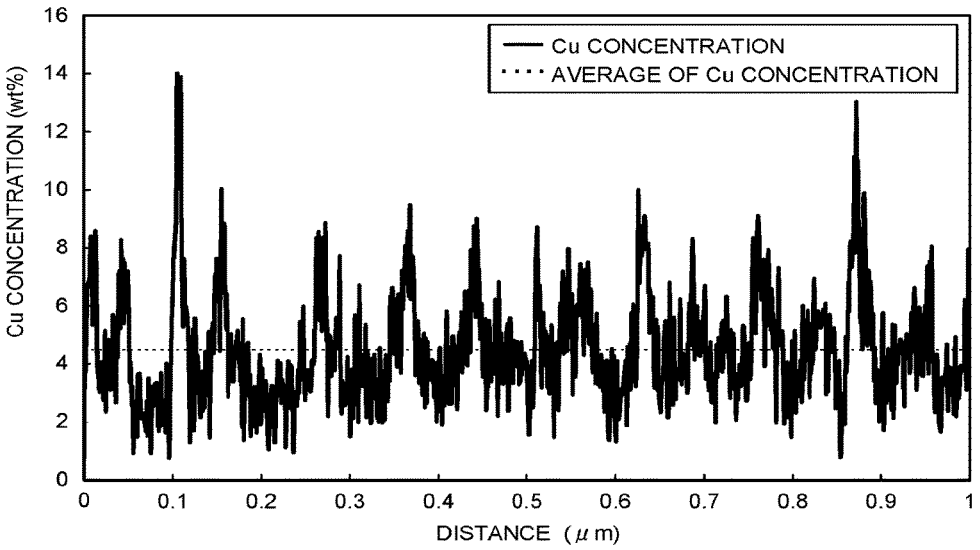
FIG. 5 is a graph illustrating an example of a line analysis result of the copper concentration illustrated in FIG. 4.
Figure 6:
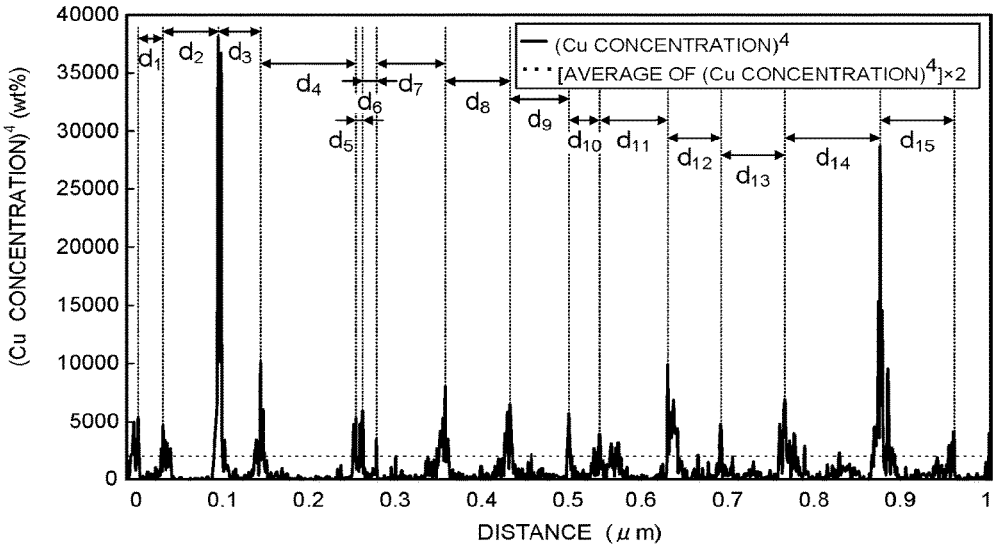
FIG. 6 is a graph in which a density difference in the line analysis result of the copper concentration illustrated in FIG. 5 is emphasized.

Next, a Cu concentration is obtained from each line analysis result (La1 to Lan and Lb2 to Lbn) of the TEM image. FIG. 5 illustrates a measured result of the Cu concentration by the line analysis La4. Further, in order to clarify a difference between Cu concentrations, the Cu concentration obtained by the line analysis is raised to the second power to the sixteenth power, and the values are turned into a graph to obtain an average value. FIG. 6 illustrates a graph in which data of the Cu concentrations in FIG. 5 raised to the fourth power is plotted. In the graph, a solid line indicates a data value (fourth power value) of the Cu concentration of each point, and a dotted line indicates a value of two times an average thereof. In FIG. 6, a region in which a width of a portion where the Cu concentration data values (fourth power values of the Cu concentrations) are sequentially larger than the two-time value of the average value is equal to or more than 2 nm is regarded as a Cu-rich phase, and a position in which the Cu concentration data value is maximum in the region is regarded as a center position of the Cu-rich phase.

(4) Cu-Rich Phase Average Interval Measuring Step

A distance (distance between peaks where the Cu densities presents maximum values/d1, d2 . . . dn in FIG. 6) between the center positions of the Cu-rich phases specified in the step 3 are each regarded as a distance between the Cu-rich phases and measured. A distance da1 between the Cu-rich phases in one composition line analysis is obtained as an average value of respective distances between peaks d1, d2 . . . dn. Measurement of the distances between phases as above is performed to all the line analysis results, and an average value of the distances between phases (da1 to dan and db1 to dbn) of the respective line analysis results is obtained. The average value [(da1+da2 . . . +dan+db1+db2 . . . +dbn)/2n] of the distances between phases is defined as an average distance (average interval of Cu-rich phases) d between the Cu-rich phases.

A thickness of the Cu-rich phase is a width of a region with different contrast between a crystal grain (2-17 phase) with uniform contrast and a neighboring crystal grain (2-17 phase) with uniform contrast, in the TEM image of the cross section including the crystal c axis of the 2-17 phase. An average thickness t of the Cu-rich phase represents an average value of the widths of the regions with different contrast, equal to or more than five widths being measured, in the TEM image (TEM image illustrated in FIG. 3, for example) of magnification of 100 k times. More specifically, there are selected arbitrary portions of a plate shape, a stick shape, or a streak shape in which contrast can be recognized. A length (thickness) in a short axis direction on an observed image of the portion with different contrast is measured, and the length is a thickness t1 of the Cu-rich phase. Such measurement is performed five times, and an average value of the thicknesses t1 to t5 of the Cu-rich phases is defined as the average thickness t of the Cu-rich phase.

If a clear Cu-rich phase cannot be identified on the observed image, as described in the step 3 of how to obtain the average interval d of the Cu-rich phase described above, the region in which the width of the portion where the Cu concentration data (fourth power values of the Cu concentration) are sequentially larger than the two-time value of the average value is equal to or larger than 2 nm in FIG. 6 is regarded as the Cu-rich phase, and the width of this region can be measured to obtain the average thickness t of the Cu-rich phases. For example, thicknesses t1 to t5 of five Cu-rich phases is obtained on the data (fourth power value of the Cu concentration) of the Cu concentration, and an average value thereof can be defined as an average thickness t of the Cu-rich phase.

According to the permanent magnet of the embodiment, in the $Sm_2Co_{17}$ type magnet which includes the two-phase structure of the 2-17 phase and the Cu-rich phase, since the magnetic domain wall pinning effect is controlled based on the average interval d of the Cu-rich phase, the magnetization current necessary for magnetizing can be reduced while the variable width is secured. Further, by controlling the average thickness t of the Cu-rich phase, the proper magnetic coercive force can be obtained. Therefore, it becomes possible to provide a permanent magnet which has a magnetic coercive force and a variable width that are suitable for a variable magnet, and additionally in which a magnetization current necessary for magnetizing is small. Application of such a permanent magnet to a variable magnet of a variable magnetic flux motor or a variable magnetic flux generator can realize further low power consumption of the variable magnetic flux motor or the variable magnetic flux generator.

The permanent magnet of this embodiment is fabricated as described below, for example. First, an alloy powder containing a predetermined amount of element is fabricated. The alloy powder is prepared by fabricating a flak-shaped alloy thin band by a strip cast method, for example, and then grinding. In the strip cast method, it is preferable to tilt-pour an alloy molten metal into a chill roll rotating at a peripheral speed of 0.1 to 20 m/sec thereby to obtain a thin band solidified to have a thickness of equal to or less than 1 mm continuously. If the peripheral speed of the chill roll is less than 0.1 m/sec, compositional variation easily occurs in a thin band, and if the peripheral speed exceeds m/sec, a crystal grain is minimized to have a size of equal to or less than a single magnetic domain size and a good magnetic property cannot be obtained. It is more preferable that the peripheral speed of the chill roll is in a range of 0.3 to 15 m/sec, and it is further preferable that the peripheral speed of the chill roll is in a range of 0.5 to 12 m/sec.

An alloy powder can be also obtained by grinding an alloy ingot obtained by casting metal melted with an arc melting or a high-frequency melting. As other preparation methods of the alloy powder, there can be cited a mechanical alloying method, a mechanical grinding method, a gas atomizing method, a reduction-diffusion method, and so on. A heat treatment can be performed as necessary to the alloy powder or the alloy before grinding, thereby to homogenize the alloy powder or the alloy before grinding. Grinding of a flake or the ingot is performed by using a jet mill, a ball mill, or the like. It is preferable that grinding is performed in an inert gas atmosphere or in an organic solvent in order to prevent oxidation of the alloy powder.

Next, the alloy powder is filled into a mold installed in an electromagnet or the like, and is pressure-formed while a magnetic field is applied, whereby a pressed powder body in which a crystal axis is oriented is fabricated. The pressed powder body is sintered at a temperature of 1100 to 1300° C. for 0.5 to 15 hours, and a dense sintered body is obtained. If a sintering temperature is less than 1100° C., a density of the sintered body becomes insufficient, and if the sintering temperature exceeds 1300° C., a rare earth element such as Sm vaporizes, and a good magnetic property cannot be obtained. It is more preferable that the sintering temperature is in a range of 1150 to 1250° C., and it is further preferable that the sintering temperature is in a range of 1180 to 1230° C.

If a sintering time is less than 0.5 hours, there is a possibility that the density of the sintered body becomes uneven. If the sintering time exceeds 15 hours, the rare earth element such as Sm vaporizes and a good magnetic property cannot be obtained. It is more preferable that the sintering time is in a range of 1 to 10 hours and it is further preferable that the sintering time is in a range of 1 to 4 hours. It is preferable to perform sintering of the pressed powder body in a vacuum or in an inert atmosphere such as argon gas in order to prevent oxidation.

A solution treatment and an aging treatment are performed to the obtained sintered body to control a crystal structure. It is preferable that the solution treatment of the sintered body is heat-treated at a temperature in a range of 1130 to 1230° C. for 0.5 to 8 hours in order to obtain the 1-7 phase being a precursor of a phase separation structure. At a temperature less than 1130° C. and a temperature over 1230° C., a proportion of the 1-7 phase in a sample after the solution treatment is small and a good magnetic property cannot be obtained. It is more preferable that a solution treatment temperature is in a range of 1150 to 1210° C., and it is further preferable that the solution treatment temperature is in a range of 1160 to 1190° C.

If a solution treatment time is less than 0.5 hours, a constitutional phase tends to become uneven. Further, if the solution treatment is performed for over 8 hours, the rare earth element such as Sm in the sintered body vaporizes and so on, leading to a possibility that a good magnetic property cannot be obtained. It is more preferable that the solution treatment time is in a range of 1 to 8 hours, and it is further preferable that the solution treatment time is in a range of 1 to 4 hours. It is preferable that the solution treatment is performed in a vacuum or an inert atmosphere such as argon gas in order to prevent oxidation.

Next, the aging treatment is performed to the sintered body after the solution treatment. An aging treatment condition is a main factor to control the average interval d and the average thickness t of the Cu-rich phase. The optimum aging treatment condition also varies depending on the alloy composition. A precipitation behavior of the Cu-rich phase varies depending on a composition ratio of the elements constituting the permanent magnet (sintered body). Therefore, it is preferable to select a temperature enabling the Cu-rich phase to dispersedly precipitate into the structure in a manner that the average interval d becomes properly large depending on the alloy composition, as the aging treatment condition (aging temperature) of the sintered body.

In a manufacturing process of the permanent magnet of the embodiment, the aging treatment is performed at a temperature T satisfying a formula (3) and a formula (4) presented below.

$$TB+50<T<TB+150 \quad (3)$$

$$TB=3500p-5000q-(50p)^2 \quad (4)$$

In the formula (4), p is a value indicating a density of Fe in the composition formula of the formula (1), and q is a value indicating a density of the element M in the composition formula of the formula (1). By performing the aging treatment at the temperature T satisfying the formula (3) and the formula (4), the average interval d of the Cu-rich phase can be controlled to be in the range of 120 nm<d<500 nm. The average thickness t of the Cu-rich phase can be also made to be equal to or less than 20 nm by performing the aging treatment to the sintered body at the temperature T.

If the aging treatment temperature is less than [TB+50(° C.)], the Cu-rich phase precipitates microscopically and the average interval d tends to become 120 nm or less. If the aging treatment temperature exceeds [TB+150 (° C.)], a rough Cu-rich phase is easy to be generated and the average interval d of the Cu-rich phase tends to become 500 nm or more. In this case, the magnetic domain wall pinning effect does not work. Thus, a phenomenon in which a magnetization curve rapidly rises at a time of a magnetic force increase after a magnetic force decrease, that is, what is called a springback phenomenon occurs, and a variable width required as a variable magnet cannot be secured. Thus, a good magnetic property as a variable magnet cannot be obtained.

It is preferable that an aging treatment time is in a range from 0.25 to 12 hours. If the aging treatment time is less than 0.25 hours, there is a possibility that nucleation of the Cu-rich phase cannot occur sufficiently. If the aging treatment time exceeds 12 hours, the Cu-rich phase becomes coarse or the average interval d becomes too large. It is more preferable that the aging treatment time is in a range from 0.25 to 8, further in a range from 1 to 4 hours.

As described above, by performing the aging treatment at the temperature T which is set based on the alloy composition to the sintered body after the solution treatment, it is possible to disperse the Cu-rich phases in the structure in a manner that the average interval d is in the range of 120 nm<d<500 nm. It should be noted that the aging treatment can be performed more than once, such as, after the sintered body is heat-treated (first aging treatment) at a temperature T1 satisfying the temperature T and is heat-treated (second aging treatment) at a temperature T2 higher than the temperature T1, and so on.

It is preferable that, after the aging treatment is performed, cooling is performed at a cooling speed in a range from 0.2 to 2° C./min. If the cooling speed after the aging treatment is less than 0.2° C./min, there is a possibility that an increased size of a thickness of the Cu-rich phase causes a magnetic coercive force to become gigantic or that the crystal grain becomes too coarse to obtain a good magnetic property. If the cooling speed exceeds 2° C./min, element dispersion does not proceed sufficiently, and thus there is a possibility that a Cu concentration difference between the 2-17 phase and the Cu-rich phase cannot be obtained sufficiently. It is more preferable that the cooling speed is in a range of 0.4 to 1.5° C./min, and it is further preferable that the cooling speed is in a range of 0.5 to 1.3° C./min. It is preferable that the aging treatment is performed in a vacuum or an inert atmosphere such as argon gas in order to prevent oxidation.

The permanent magnet of this embodiment is suitable as a variable magnet. By using the permanent magnet of this embodiment as the variable magnet, a variable magnetic flux motor or a variable magnetic flux generator can be constituted. To a constitution or a drive system of the variable magnetic flux motor, techniques disclosed in JP-A 2008-29148 (KOKAI) and JP-A No. 2008-43172 (KOKAI) can be applied. Use of the permanent magnet of this embodiment as the variable magnet in a variable magnetic flux drive system promotes a high efficiency, miniaturization, a cost reduction or the like of the system.

Figure 7:
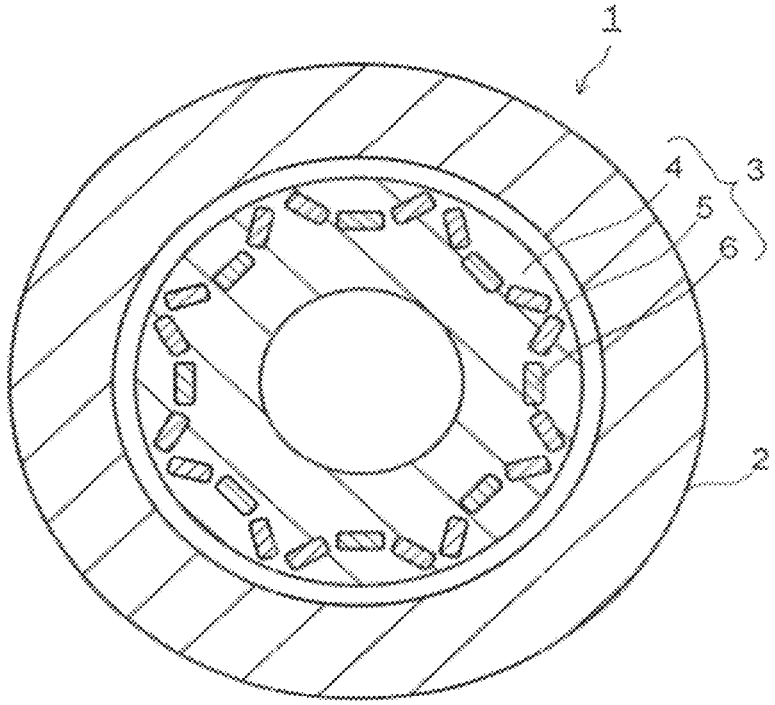
FIG. 7 is a diagram illustrating a variable magnetic flux motor of the embodiment.
Figure 8:
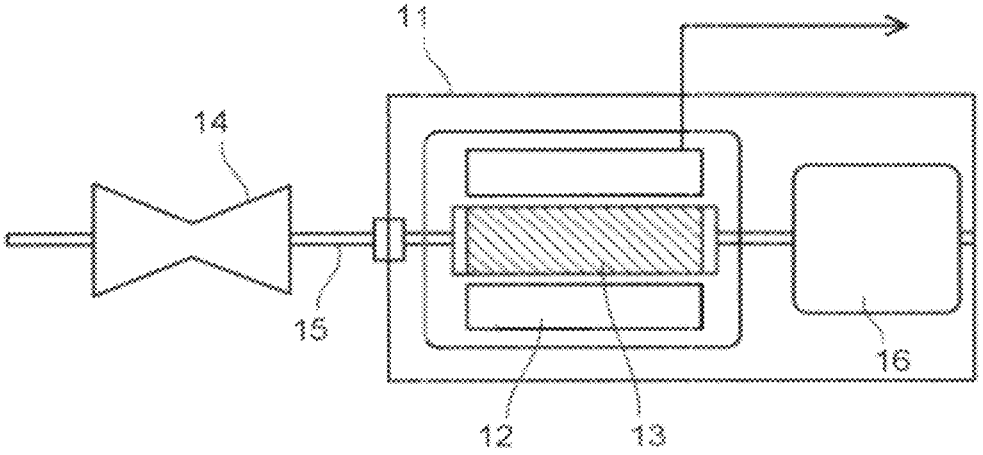
FIG. 8 is a diagram illustrating a variable magnetic flux generator of the embodiment.

Next, a variable magnetic flux motor and a variable magnetic flux generator of the embodiment will be explained with reference to the drawings. FIG. 7 illustrates the variable magnetic flux motor of the embodiment, and FIG. 8 illustrates the variable magnetic flux generator of the embodiment. Though the permanent magnet of the embodiment is suitable for a magnet of the variable magnetic flux motor or the variable magnetic flux generator, application of the permanent magnet of the embodiment to a permanent magnet motor or the like is not prevented.

In a variable magnetic flux motor 1 illustrated in FIG. 7, a rotor 3 is disposed in a stator 2. A stationary magnet 5 and a variable magnet 6 for which a permanent magnet with a magnetic coercive force lower than that of the stationary magnet 5 is used are disposed in an iron core 4 in the rotor 3. A magnetic flux density (magnetic flux amount) of the variable magnet 6 is able to be changed. Since a magnetization direction of the variable magnet 6 is orthogonal to a Q axis direction, the variable magnet 6 is not affected by a Q axis current and can be magnetized by a D axis current. The rotor 3 is provided with a magnetization coil (not shown), and it is structured so that by supplying a current from a magnetization circuit to the magnetization coil a magnetic field thereof directly acts on the variable magnet 6.

According to the permanent magnet of the embodiment, by changing various conditions of the above-described method of manufacturing, it is possible to obtain the stationary magnet 5 with a magnetic coercive force of equal to or more than 200 kA/m and the variable magnet 6 with a magnetic coercive force of equal to or less than 160 kA/m, for example. It should be noted that in the variable magnetic flux motor 1 illustrated in FIG. 7, though it is possible that the permanent magnet of the embodiment is used for both of the stationary magnet 5 and the variable magnet 6, the permanent magnet of the embodiment may be used for either one of the magnets. The variable magnetic flux motor 1, which can output a large torque by a small device size, is suitable for a motor of a hybrid vehicle, an electric vehicle or the like in which a high power and downsizing of a motor is required.

A variable magnetic flux generator 11 illustrated in FIG. 8 includes a stator 12 using the permanent magnet of the embodiment. A rotor 13 disposed inside the stator 12 is connected to a turbine 14 provided in one end of the variable magnetic flux generator 11 via a shaft 15. The turbine 14 is constituted to be rotated by a fluid provided from the outside, for example. It should be noted that the shaft 15 can be rotated, instead of by the turbine 14 rotated by the flux, by transmitting a dynamic rotation such as regenerated energy of an automobile or the like. As the stator 12 and the rotor 13, various known constitutions can be adopted.

Further, the shaft 15 contacts a commutator (not shown) disposed in an opposite side of the turbine 16 in relation to the rotor 13, and an electromotive force generated by a rotation of the rotor 13 is boosted to a system voltage and transmitted as an output of the variable magnetic flux generator via a phase separation bus bar and a main transformer (not shown). Since electrification by a static electricity from the turbine 14 or electrification by an axis current brought by power generation occurs in the rotor 13, the variable magnetic flux generator 11 includes a brush 16 for discharging the electrification of the rotor 13.

Next, examples and evaluation results thereof will be described.

Example 1

After respective materials are weighed for a composition $(Sm_{0.85}Nd_{0.15})$ $(Fe_{0.28}Zr_{0.025}Cu_{0.05}Co_{0.645})_{7.8}$, the respective materials are arc-melted in an Ar gas atmosphere to form an alloy ingot. The alloy ingot is heat-treated in an Ar gas atmosphere under a condition of 1170° C.×1 hour. The heat-treated alloy ingot is coarsely ground, and further, is finely ground by a jet mill, so that an alloy powder is prepared. The alloy powder is pressed in a magnetic field to form a pressed powder body, and the pressed powder body is sintered in an Ar gas atmosphere at 1190° C. for three hours, and is subsequently heat-treated at 1170° C. for three hours. The heat treatment after sintering is performed for a solution treatment. In this way, a sintered body is obtained.

Next, the sintered body after the solution treatment was heat-treated under a condition of 805° C.×6 hours as an aging treatment, thereafter the sintered body is slowly cooled to 600° C. at a cooling speed of 2° C./min. In this way, an aimed sintered magnet is obtained. Here, a temperature TB based on an alloy composition (p=0.28, q=0.025) is about 659° C. Therefore, an aging treatment temperature T (805° C.) satisfies a range of [TB+50 (709° C.)<T<TB+150 (809° C.)]. A composition of the magnet is confirmed by an ICP method. The sintered magnet obtained as above is subjected to a later-described property evaluation.

Examples 2 to 4

Sintered magnets are each fabricated similarly to in Example 1 except that an alloy powder whose composition is presented in Table 1 is used. An aging treatment condition is the same as that of Example 1. Here, a temperature TB (° C.) based on each alloy composition, [TB+50 (° C.)], and [TB+150 (° C.)] are as presented in Table 2. The sintered magnet obtained as above is subjected to the later-described property evaluation.

Comparative Example 1

A sintered body is fabricated by using an alloy powder of a composition the same as that of Example 1 under a condition the same as that of Example 1. The sintered body is heat-treated under a condition of 705° C.×6 hours as an aging treatment, thereafter the sintered body is slow-cooled to 600° C. at a cooling speed of 2° C./min. Here, since a temperature TB based on an alloy composition is about 659° C. similarly to in Example 1, an aging treatment temperature T (705° C.) is out of the range of [TB+50 (709° C.)<T<TB+150 (809° C.)].

Comparative Example 2

A sintered body is fabricated by using an alloy powder of a composition the same as that of Example 1 under a condition the same as that of Example 1. The sintered body is heat-treated under a condition of 870° C.×6 hours as an aging treatment, thereafter the sintered body is slow-cooled to 600° C. at a cooling speed of 2° C./min. Here, since a temperature TB based on an alloy composition is about 659° C. similarly to in Example 1, an aging treatment temperature T (870° C.) is out of the range of [TB+50 (709° C.)<T<TB+150 (809° C.)].

Example 5

After respective materials are weighed for a composition $(Sm_{0.9}Nd_{0.1})$ $(Fe_{0.34}Zr_{0.03}Cu_{0.05}Co_{0.58})_{7.5}$, the respective materials are arc-melted in an Ar gas atmosphere to form an alloy ingot. The alloy ingot is loaded into a quartz nozzle and molten by high-frequency induction heating, molten metal is tilt-poured into a chill roll rotating at a peripheral speed of 0.6 m/sec and solidified continuously to form a thin ribbon. The thin ribbon is coarsely ground, and further, is finely ground by a jet mill, so that an alloy powder is prepared. The alloy powder is pressed in a magnetic field to form a pressed powder body, and the pressed powder body is sintered in an Ar gas atmosphere at 1200° C. for one hour, and is subsequently heat-treated at 1180° C. for 4 hours. The heat treatment after sintering is performed for a solution treatment. In this way, a sintered body is obtained.

Next, the sintered body after the solution treatment is heat-treated under a condition of 860° C.×4 hours as an aging treatment, thereafter the sintered body is slowly cooled to 500° C. at a cooling speed of 1.3° C./min. In this way, an aimed sintered magnet is obtained. Here, a temperature TB based on an alloy composition (p=0.34, q=0.03) is about 751° C. Therefore, an aging treatment temperature T (860° C.) satisfies the range of [TB+50 (801° C.)<T<TB+150 (901° C.)]. A composition of the magnet is confirmed by an ICP method. The sintered magnet obtained as above is subjected to the later-described property evaluation.

Examples 6 to 7

Sintered magnets are each fabricated similarly to in Example 5 except that an alloy powder whose composition is shown in Table 1 is used. An aging treatment condition is the same as that of Example 5. Here, a temperature TB (° C.) based on each alloy composition, [TB+50 (° C.)], and [TB+150 (° C.)] are as presented in Table 2. The sintered magnet obtained as above is subjected to the later-described property evaluation.

Comparative Example 3

A sintered body is fabricated by using an alloy powder of a composition the same as that of Example 5 under a condition the same as that of Example 5. The sintered body is heat-treated under a condition of 775° C.×4 hours as an aging treatment, thereafter the sintered body is slow-cooled to 500° C. at a cooling temperature of 1.3° C./min. Here, since a temperature TB based on an alloy composition is about 751° C. similarly to in Example 5, an aging treatment temperature T (775° C.) is out of the range of [TB+50 (801° C.)<T<TB+150 (901° C.)].

Comparative Example 4

A sintered body is fabricated by using an alloy powder of a composition the same as that of Example 5 under a condition the same as that of Example 5. The sintered body is heat-treated under a condition of 925° C.×4 hours as an aging treatment, thereafter the sintered body is slow-cooled to 500° C. at a cooling speed of 1.3° C./min. Here, since a temperature TB based on an alloy composition is about 751° C. similarly to in Example 1, an aging treatment temperature T (925° C.) is out of the range of [TB+50 (801° C.)<T<TB+150 (901° C.)].

Examples 8 to 10

Sintered magnets are fabricated similarly to in Example 1 except that an alloy powder whose composition is shown in Table 1 is used. An aging treatment condition is the same as that of Example 1. Here, a temperature TB (° C.) based on each alloy composition, [TB+50 (° C.)], and [TB+150 (° C.)] are as presented in Table 2. The sintered magnet obtained as above is subjected to the later-described property evaluation.

TABLE 1

| | Magnet Composition (Atomic Ratio) |
|---|---|
| Example 1 | $(Sm_{0.85}Nd_{0.15})(Fe_{0.28}Zr_{0.025}CU_{0.05}Co_{0.645})_{7.8}$ |
| Example 2 | $Sm(Fe_{0.31}(Ti_{0.1}Zr_{0.9})_{0.04}Cu_{0.06}Co_{0.59})_{8.2}$ |
| Example 3 | $(Sm_{0.95}Pr_{0.05})(Fe_{0.3}Zr_{0.03}Cu_{0.07}Co_{0.60})_{8.1}$ |
| Example 4 | $Sm(Fe_{0.32}Zr_{0.035}Cu_{0.06}Co_{0.585})_{7.9}$ |
| Comparative Example 1 | $(Sm_{0.85}Nd_{0.15})(Fe_{0.28}Zr_{0.025}Cu_{0.05}Co_{0.645})_{7.8}$ |
| Comparative Example 2 | $(Sm_{0.85}Nd_{0.15})(Fe_{0.28}Zr_{0.025}Cu_{0.05}Co_{0.645})_{7.8}$ |
| Example 5 | $(Sm_{0.9}Nd_{0.1})(Fe_{0.34}Zr_{0.03}Cu_{0.05}Co_{0.58})_{7.5}$ |
| Example 6 | $Sm(Fe_{0.38}(Ti_{0.2}Zr_{0.8})_{0.035}Cu_{0.06}Co_{0.525})_{7.7}$ |
| Example 7 | $Sm(Fe_{0.4}(Ti_{0.1}Zr_{0.9})_{0.037}Cu_{0.055}Co_{0.508})_{7.6}$ |
| Comparative Example 3 | $(Sm_{0.9}Nd_{0.1})(Fe_{0.34}Zr_{0.03}Cu_{0.05}Co_{0.58})_{7.5}$ |
| Comparative Example 4 | $(Sm_{0.9}Nd_{0.1})(Fe_{0.34}Zr_{0.03}Cu_{0.05}Co_{0.58})_{7.5}$ |
| Example 8 | $(Sm_{0.8}Nd_{0.2})(Fe_{0.32}Zr_{0.028}Cu_{0.055}Mn_{0.02}Co_{0.577})_{8.2}$ |
| Example 9 | $Sm(Fe_{0.30}Zr_{0.03}Cu_{0.05}Co_{0.605}Ga_{0.015})_{7.9}$ |
| Example 10 | $(Sm_{0.75}Pr_{0.25})(Fe_{0.29}Zr_{0.028}Si_{0.02}Cu_{0.06}Co_{0.602})_{8.35}$ |

TABLE 2

| | Aging Treatment Condition | | | | |
|---|---|---|---|---|---|
| | TB (° C.) | TB + 50 (° C.) | TB + 150 (° C.) | Temperature T (° C.) | Time (h) |
| Example 1 | 659 | 709 | 809 | 805 | 6 |
| Example 2 | 670 | 720 | 820 | 805 | 6 |
| Example 3 | 675 | 725 | 825 | 805 | 6 |
| Example 4 | 689 | 739 | 839 | 805 | 6 |
| Comparative Example 1 | 659 | 709 | 809 | 705 | 6 |
| Comparative Example 2 | 659 | 709 | 809 | 870 | 6 |
| Example 5 | 751 | 801 | 901 | 870 | 4 |
| Example 6 | 810 | 860 | 960 | 870 | 4 |
| Example 7 | 815 | 865 | 965 | 870 | 4 |
| Comparative Example 3 | 751 | 801 | 901 | 775 | 4 |
| Comparative Example 4 | 751 | 801 | 901 | 925 | 4 |
| Example 8 | 724 | 774 | 874 | 805 | 6 |
| Example 9 | 675 | 725 | 825 | 805 | 6 |
| Example 10 | 665 | 715 | 815 | 805 | 6 |

With regard to the sintered magnets of Examples 1 to 10 and Comparative Examples 1 to 4, cross sections including crystal c axes of 2-17 phases are observed by a TEM. As a result, it is confirmed that each of the sintered magnets has a two-phase structure of the 2-17 phase (grain interior phase) and a Cu-rich phase (grain boundary phase). Cu densities of the grain interior phase and the Cu-rich phase are measured and confirmed that a ratio of the Cu concentration of the grain boundary phase in relation to the Cu concentration of the grain interior phase is equal to or more than 1.2 times and equal to or less than 5 times in each sintered magnet. Next, a composition line analysis of a TEM image is performed based on the above-described method and an average interval d of the Cu-rich phase is obtained from a line analysis result. A magnification of the TEM image is 100 k times and an interval of the line analysis is 50 nm. Further, an average thickness t of the Cu-rich phase is obtained from the TEM image based on the above-described method. Those results are presented in Table 3.

Next, a magnetic property of each of the sintered magnets is evaluated by a BH tracer, and a residual magnetization Mr and a magnetic coercive force Hcj are measured. Further, H(minor) and H(major) are obtained based on the above-described method from magnetic curves (a major loop and a minor loop) obtained by the BH tracer, and a H(minor)/H(major) ratio is calculated. Those results are presented in Table 3.

TABLE 3

| | Average Interval d of Cu-Rich Phase [nm] | Average Thickness t of Cu-Rich Phase [nm] | Magnetic Property | | |
|---|---|---|---|---|---|
| | | | Magnetic Coercive Force Hcj[kA/m] | Residual Magnetization Mr[T] | H(minor)/H(major) |
| Example 1 | 122 | 14 | 380 | 1.18 | 0.66 |
| Example 2 | 140 | 10 | 370 | 1.19 | 0.75 |
| Example 3 | 130 | 8 | 370 | 1.18 | 0.89 |
| Example 4 | 145 | 7 | 340 | 1.20 | 0.82 |
| Comparative Example 1 | 108 | 6 | 550 | 1.15 | 0.96 |
| Comparative Example 2 | 530 | 24 | 540 | 1.16 | 0.42 |
| Example 5 | 125 | 6 | 350 | 1.20 | 0.73 |
| Example 6 | 140 | 4 | 215 | 1.21 | 0.58 |
| Example 7 | 145 | 2 | 205 | 1.22 | 0.66 |
| Comparative | 110 | 7 | 300 | 1.19 | 0.97 |

TABLE 3-continued

| | Average Interval d of Cu-Rich Phase [nm] | Average Thickness t of Cu-Rich Phase [nm] | Magnetic Property Magnetic Coercive Force Hcj[kA/m] | Residual Magnetization Mr[T] | H(minor)/H(major) |
|---|---|---|---|---|---|
| Example 3 | | | | | |
| Comparative Example 4 | 520 | 21 | 280 | 1.17 | 0.45 |
| Example 8 | 129 | 8 | 210 | 1.20 | 0.68 |
| Example 9 | 142 | 10 | 250 | 1.18 | 0.73 |
| Example 10 | 135 | 12 | 375 | 1.17 | 0.76 |

As is obvious from Table 3, the average intervals d of the Cu rich-phases in the sintered magnets of Examples 1 to 10 are each over 120 nm and less than 500 nm, and the average thicknesses t of the Cu-rich phases are equal to or less than 20 nm. As a result, it is confirmed that the sintered magnets of the examples, whose magnetic coercive forces are 200 to 400 kA/m and whose H(minor)/H(major) ratios are less than 0.95, have magnet properties suitable for variable magnets. In contrast, it is confirmed that permanent magnets of Comparative Examples 1, 3, whose Cu-rich phase average intervals d are equal to or less than 120 nm and thus whose H(minor)/H(major) ratios are equal to or more than 0.95, has not obtained good magnetizations. Since the average intervals d of the Cu-rich phases of permanent magnets of Comparative Examples 2, 4 are equal to or more than 500 nm, magnetic coercive forces of equal to or more than 500 kA/m are exhibited due to work of magnetic domain wall pinning type magnetic coercive force mechanisms, and the magnetic coercive force suitable for the variable magnet has not been obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A permanent magnet comprising:

a composition expressed by the following composition formula:

$$Sm(Fe_pM_qCu_r(Co_{1-s}A_s)_{1-p-q-r})_z,$$

wherein M is at least one element selected from the group consisting of Ti, Zr, and Hf, wherein a content of Ti is 10 atomic % or less of the element M, A is at least one element selected from the group consisting of Ni, V, Cr, Mn, Al, Nb, Ta, and W, p is a number, which is an atomic ratio, satisfying $0.31 \leq p \leq 0.6$, q is a number, which is an atomic ratio, satisfying $0.005 \leq q \leq 0.1$, r is a number, which is an atomic ratio, satisfying $0.01 \leq r \leq 0.15$, s is a number, which is an atomic ratio, satisfying $0 \leq s \leq 0.2$, z is a number, which is an atomic ratio, satisfying $4 \leq z \leq 9$; and a structure which comprises a $Th_2Zn_{17}$ crystal phase and a copper-rich phase having a copper concentration by weight percent from 1.2 to 5 times a copper concentration by weight percent in the $Th_2Zn_{17}$ crystal phase, wherein an average interval d between the copper-rich phases in a cross section including a crystal c axis of the $Th_2Zn_{17}$ crystal phase is greater than 120 nm and less than 500 nm, and wherein a magnetic coercive force of the permanent magnet is from 100 to 500 kA/m, and a residual magnetization of the permanent magnet is 1.17 T or more.

2. The permanent magnet according to claim 1, wherein an average thickness of the copper-rich phase is in a range from 1 to 20 nm.

3. The permanent magnet according to claim 1, wherein 50 atomic % or more of the element M is zirconium.

4. A variable magnetic flux motor, comprising:

the permanent magnet according to claim 1 as a variable magnet.

5. A variable magnetic flux generator, comprising:

the permanent magnet according to claim 1 as a variable magnet.

6. The permanent magnet according to claim 1, wherein a ratio of H(minor) to H(major) of the permanent magnet is less than 0.95, where H(major) is a magnetic field at the time when magnetization reaches 80% of a saturation magnetization Ms in a major loop, and H(minor) is a magnetic field at the time when magnetization reaches 80% of the saturation magnetization Ms in a minor loop.

7. The permanent magnet according to claim 1, wherein the permanent magnet is a variable magnet.

8. The permanent magnet according to claim 1, wherein 50 atomic % or more and 90 atomic % or less of the element M is zirconium.

9. The permanent magnet according to claim 1, wherein the structure of the permanent magnet consists essentially of the $Th_2Zn_{17}$ crystal phase and the copper-rich phase.

10. The permanent magnet according to claim 1, wherein the element M is zirconium.

11. The permanent magnet according to claim 1, wherein the composition is expressed by the following composition formula:

$$Sm(Fe_pM_qCu_rCo_{1-p-q-r})_z,$$

wherein M is at least one element selected from the group consisting of Ti, Zr, and Hf, wherein a content of Ti is 10 atomic % or less of the element M, p is a number, which is an atomic ratio, satisfying $0.31 \leq p \leq 0.6$, q is a number, which is an atomic ratio, satisfying $0.005 \leq q \leq 0.1$, r is a number, which is an atomic ratio, satisfying $0.01 \leq r \leq 0.15$, sz is a number, which is an atomic ratio, satisfying $4 \leq z \leq 9$.

12. A method for manufacturing a permanent magnet, comprising:

fabricating an alloy powder having a composition expressed by the following composition formula:

$$Sm(Fe_pM_qCu_r(Co_{1-s}A_s)_{1-p-q-r})_z,$$

wherein M is at least one element selected from the group consisting of Ti, Zr, and Hf, wherein a content of Ti is 10 atomic % or less of the element M, A is at least one element selected from the group consisting of Ni, V, Cr, Mn, Al, Nb, Ta, and W, p is a number, which is an atomic ratio, satisfying $0.31 \leq p \leq 0.6$, q is a number, which is an atomic ratio, satisfying $0.005 \leq q \leq 0.1$, r is a number, which is an atomic ratio, satisfying $0.01 \leq r \leq 0.15$, s is a number, which is an atomic ratio, satisfying $0 \leq s \leq 0.2$, z is a number, which is an atomic ratio, satisfying $4 \leq z \leq 9$; and press-forming the alloy powder in a magnetic field to form a pressed powder body;

sintering the pressed powder body to form a sintered body;

performing a solution treatment to the sintered body;

performing an aging treatment to the sintered body after the solution treatment at a temperature T ° C. satisfying 805° C.≤T or TB+50<T<TB+150 for from 0.25 to 8 hours, wherein TB ° C. is a temperature represented by the formula: $3500p-5000q-(50p)^2$, and fabricating a sintered magnet as the permanent magnet by cooling the sintered body after the aging treatment at a cooling speed of from 1.3 to 2° C./min, wherein the sintered magnet comprises a structure which includes a $Th_2Zn_{17}$ crystal phase and a copper-rich phase having a copper concentration by weight percent in a range from 1.2 to 5 times a copper concentration by weight percent in the $Th_2Zn_{17}$ crystal phase, wherein an average interval d between the copper-rich phases in a cross section including a crystal c axis of the $Th_2Zn_{17}$ crystal phase is in a range of over 120 nm and less than 500 nm, and wherein the sintered magnet has a magnetic coercive force of from 100 to 500 kA/m and a residual magnetization of 1.17 T or more.

13. The manufacturing method according to claim 12, wherein an average thickness of the copper-rich phase in the sintered magnet is from 1 to 20 nm.

14. The manufacturing method according to claim 12, wherein the sintered magnet has a ratio of H(minor) to H(major) of less than 0.95, where H(major) is a magnetic field at the time when magnetization reaches 80% of a saturation magnetization Ms in a major loop, and H(minor) is a magnetic field at the time when magnetization reaches 80% of the saturation magnetization Ms in a minor loop.

15. The manufacturing method according to claim 12, wherein the solution treatment is performed at a temperature of from 1130 to 1230° C. for from 0.5 to 8 hours.

16. The manufacturing method according to claim 12, wherein 50 atomic % or more and 90 atomic % or less of the element M is zirconium.

17. The manufacturing method according to claim 12, wherein the structure of the sintered magnet consists essentially of the $Th_2Zn_{17}$ crystal phase and the copper-rich phase.

18. The manufacturing method according to claim 12, wherein the element M is zirconium.

19. The manufacturing method according to claim 12, wherein the composition is expressed by the following composition formula:

$$Sm(Fe_pM_qCu_rCo_{1-p-q-r})_z,$$

wherein M is at least one element selected from the group consisting of Ti, Zr, and Hf, wherein a content of Ti is 10 atomic % or less of the element M, p is a number, which is an atomic ratio, satisfying $0.31 \leq p \leq 0.6$, q is a number, which is an atomic ratio, satisfying $0.005 \leq q \leq 0.1$, r is a number, which is an atomic ratio, satisfying $0.01 \leq r \leq 0.15$, sz is a number, which is an atomic ratio, satisfying $4 \leq z \leq 9$.

* * * * *